US007387100B2

(12) United States Patent
Fiedler et al.

(10) Patent No.: US 7,387,100 B2
(45) Date of Patent: Jun. 17, 2008

(54) PISTON FOR AN INTERNAL COMBUSTION ENGINE AND COVER RING FOR THE COOLING CHANNEL OF THE PISTON

(75) Inventors: Rolf-Gerhard Fiedler, Wendlingen (DE); Rainer Scharp, Vaihingen (DE); Hans-Peter Wieland, Ditzingen (DE)

(73) Assignee: MAHLE International GmbH, Stuttgart (DE)

( * ) Notice: Subject to any disclaimer, the term of this patent is extended or adjusted under 35 U.S.C. 154(b) by 19 days.

(21) Appl. No.: 11/485,569

(22) Filed: Jul. 12, 2006

(65) Prior Publication Data

US 2007/0028863 A1 Feb. 8, 2007

(30) Foreign Application Priority Data

Aug. 6, 2005 (DE) ..... 10 2005 037 175

(51) Int. Cl.
*F02F 3/00* (2006.01)

(52) U.S. Cl. ..... 123/193.6

(58) Field of Classification Search ..... 123/193.6, 123/41.35; 92/55
See application file for complete search history.

(56) References Cited

U.S. PATENT DOCUMENTS 1,426,766 A * 8/1922 Petrie ..... 277/491
5,261,363 A * 11/1993 Kemnitz ..... 123/193.6
6,892,690 B2 * 5/2005 Gabriel et al. ..... 123/193.6
2002/0133946 A1 * 9/2002 Scharp et al. ..... 29/888.4
2005/0092279 A1 * 5/2005 Parker et al. ..... 123/193.6

FOREIGN PATENT DOCUMENTS

| | | |
|---|---|---|
| DE | 252 638 | 12/1987 |
| DE | 4 134 530 | 5/1992 |
| DE | 103 46 822.6 | 4/2005 |
| EP | 0 561 817 | 9/1993 |
| EP | 0 799 373 | 10/1997 |

* cited by examiner

*Primary Examiner*—M. McMahon
(74) *Attorney, Agent, or Firm*—Collard & Roe, P.C.

(57) ABSTRACT

A piston for an internal combustion engine has a piston head and a piston skirt spaced apart from the piston head by a ring-shaped recess. The piston has at least one pin bore for accommodating a piston pin. A ring-shaped circumferential cooling channel for a coolant is provided in the piston head, which channel is closed off by a cover ring that consists of at least two segments. At least one region of the cover ring projects at least partially into the clear opening of the at least one pin bore, in such a manner that the cover ring simultaneously forms the retaining element for the piston pin.

20 Claims, 4 Drawing Sheets

PISTON FOR AN INTERNAL COMBUSTION ENGINE AND COVER RING FOR THE COOLING CHANNEL OF THE PISTON

BACKGROUND OF THE INVENTION

1. Field of the Invention

The present invention relates to a one-part piston for an internal combustion engine, having a piston head and a piston skirt spaced apart from the former by a ring-shaped recess. The piston has at least one pin bore to accommodate a piston pin. A ring-shaped circumferential cooling channel for a coolant is provided in the piston head. The channel is closed off with a cover ring that consists of at least two segments. The present invention furthermore relates to a cover ring consisting of two or more segments, for the ring-shaped circumferential cooling channel of a one-part piston for an internal combustion engine.

2. The Prior Art

A piston of this type and a cover ring of this type are described in German Patent No. DE 103 46 822 A1. This piston has a ring-shaped cooling channel that is closed off, on the skirt side, by a cover ring that consists of two semi-circular half-shells. The cover ring has a groove by way of which the half-shells can be pushed onto a projection on the outside of the piston, shaped complementary to the groove shape, for the purpose of assembly. Furthermore, the half-shells have snap-in connections in the region of their join surfaces, by means of which the half-shells can be quickly connected with one another. However, the provision of the cover ring with an additional groove, and the provision of the piston with an additional projection, respectively, is complicated and therefore not desirable. Furthermore, assembly is difficult, because the two half-shells must be set onto the projections provided on the piston, in targeted manner.

Other comparable pistons are known from German Utility Model DD 252 638 A1 and German Patent No. DE 41 34 530 A1, in which a wall part that serves to cover the ring-shaped circumferential cooling channel, which is open towards the bottom, is configured as an open sheet-metal ring. The sheet-metal ring lies in a groove, against the inside circumference of the piston ring zone, or on the outside circumference of the combustion chamber wall, respectively, under bias in the radial direction.

Finally, one-part pistons having a cooling channel disposed in the edge region of the piston crown are known from European Patent Nos. EP 0 561 817 B1 and EP 0 799 373 B1, which is also closed off with cover rings configured like a plate spring and provided with a collar, if necessary.

With all of these embodiments, each segment of the spring-plate-like cover ring must be individually introduced into corresponding supports on the piston head, in the biased state.

SUMMARY OF THE INVENTION

It is therefore an object of the invention to provide a piston of this type, and a cover ring of this type, respectively, which contributes to a simplified design of the piston and a reduced piston weight.

This object is accomplished by a piston for an internal combustion engine, having a piston head and a piston skirt spaced apart from the piston head by a ring-shaped recess. The piston has at least one pin bore for accommodating a piston pin. A ring-shaped circumferential cooling channel for a coolant is provided in the piston head, which channel is closed off by a cover ring that consists of at least two segments. At least one region of the cover ring projects at least partially into the clear opening of the at least one pin bore, in such a manner that the cover ring simultaneously forms the retaining element for the piston pin.

The cover ring works as a retaining element, which limits the axial movement of the piston pin in the pin bore. In the prior art, this task is performed by snap rings or Seeger rings. These rings are inserted in pin retaining grooves in the pin boss. The configuration of the piston, or of the cover ring, respectively, now makes it possible to do without these snap rings or Seeger rings. With this, the present invention makes a contribution to reducing the piston weight. The present invention furthermore makes it possible to do without production of the pin retaining grooves, thereby simplifying the piston design.

In a preferred embodiment, the cover ring has an inner shank and an outer shank, which are connected with one another by means of a bottom crosspiece. This configuration of the cover ring opens up a plurality of possibilities for covering the cooling channel and/or the ring-shaped recess. For example, the inner shank can project into the clear opening of the at least one pin bore and, in this manner, form the retaining element for the piston pin that is provided on the cover ring. Furthermore, the outer shank can form the delimitation of the ring-shaped recess on the piston skirt side. The cover ring is preferably configured to be approximately U-shaped or approximately V-shaped in cross-section. However, the configuration of the two shanks and the bottom crosspiece that connects them can also be performed in any other manner (trapezoid-shaped, semi-circular, etc.).

In another embodiment, the ring-shaped recess is disposed between a face surface configured on the ring wall of the piston, and at least one shoulder formed on the piston skirt. The cover ring rests against the face surface with its outer shank, and against the at least one shoulder with its bottom crosspiece. This further development demonstrates numerous additional advantages as compared with the state of the art. In particular, both the projection that was previously necessary in the skirt connection, and the groove in the inner wall of the cover ring, which was complementary to the former, are eliminated. In this way, both the design of the piston and of the cover ring is further simplified. In particular, however, the assembly of the cover ring on the piston is possible in significantly simpler manner than before, since the complicated positioning of projection and groove relative to one another is eliminated. Furthermore, the cover ring now encloses both the former cooling channel and the ring-shaped recess, with the result that the former cooling channel and the ring-shaped recess now form a new, larger cooling channel. With this, cooling of the piston according to the invention becomes simpler and more reliable. Finally, the outer shank of the cover ring, together with the ring wall and the piston skirt, forms an almost continuous, smooth surface, which improves the running properties of the piston according to the invention.

If the inner shank of the cover ring rests against the skirt connection of the piston, the cover ring sits in its place in a particularly solid and secure manner. Furthermore, sealing of the ring-shaped recess, which now acts as a cooling channel, towards the outside, is improved.

For the purpose of controlling the flow characteristics, particularly the flow velocity, of the coolant, the configuration of the inner shank of the cover ring can also vary. For example, the height of the inner shank or the angle position of the inner shank relative to the center axis of the cover ring can vary over the circumference of the cover ring. In particular, the flow channel for the coolant formed by the cover ring can be inclined from the inlet opening to the outlet opening.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
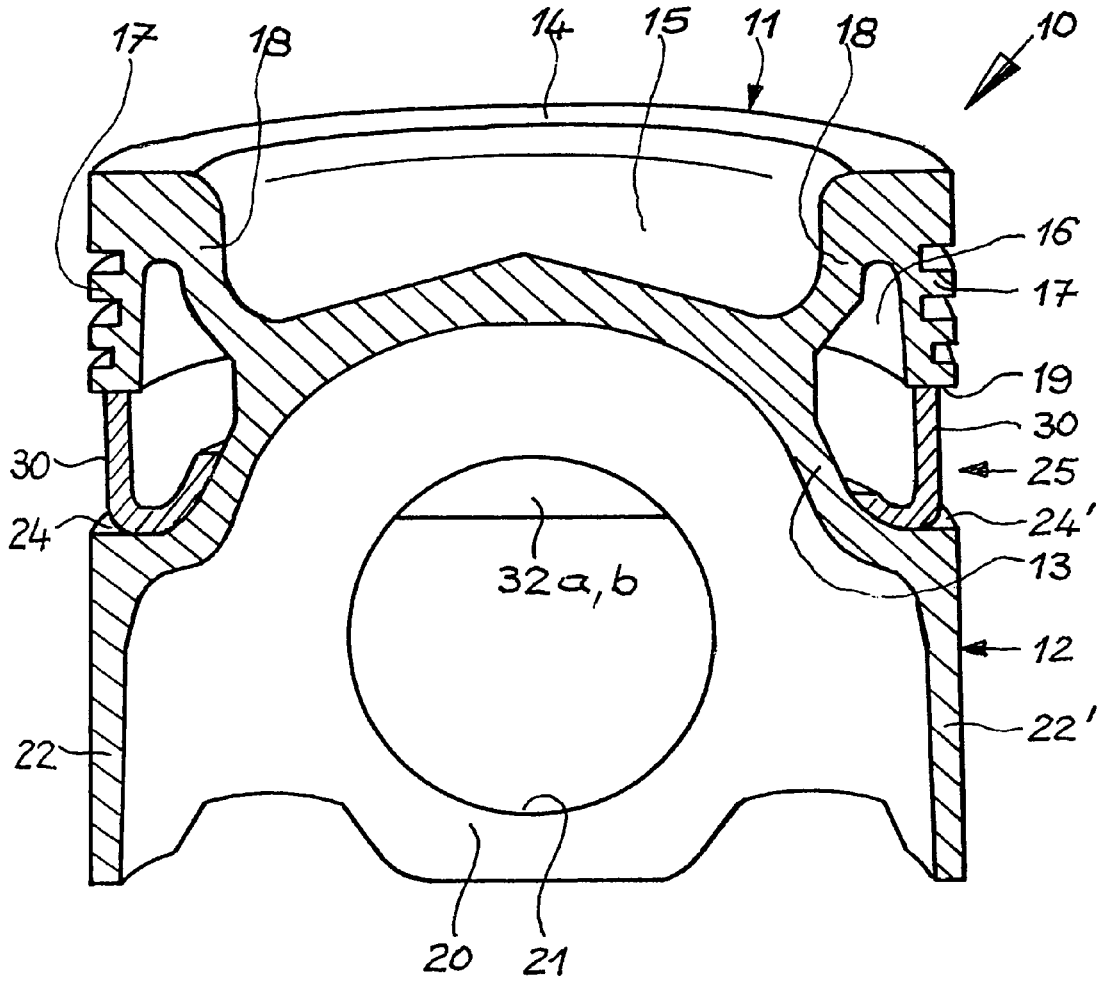
FIG. 1 shows a sectional view of an embodiment of the piston according to the invention.
Figure 2:
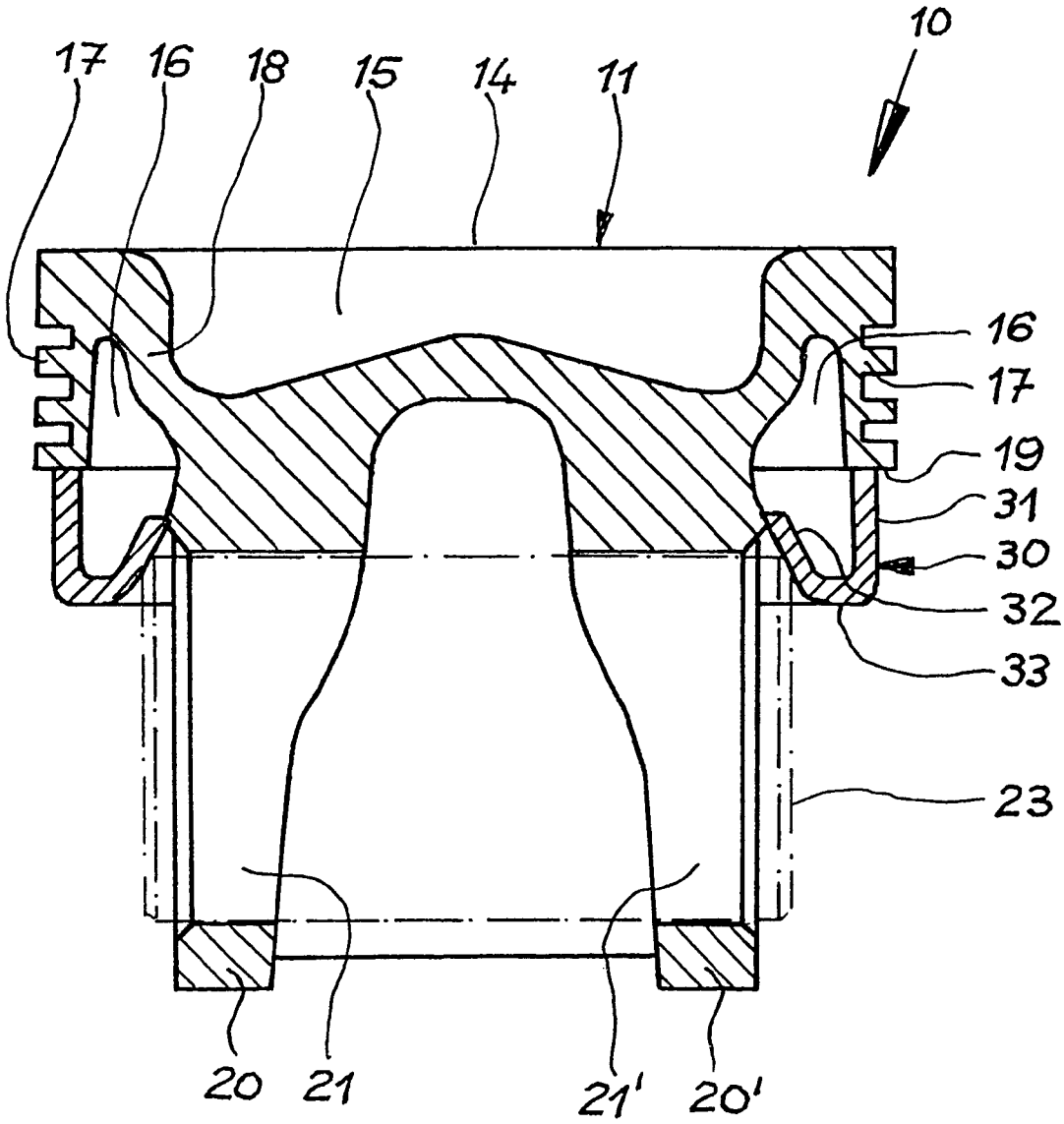
FIG. 2 shows the piston from FIG. 1, rotated by 90°, with the piston pin indicated with a dot-dash line.
Figure 4:
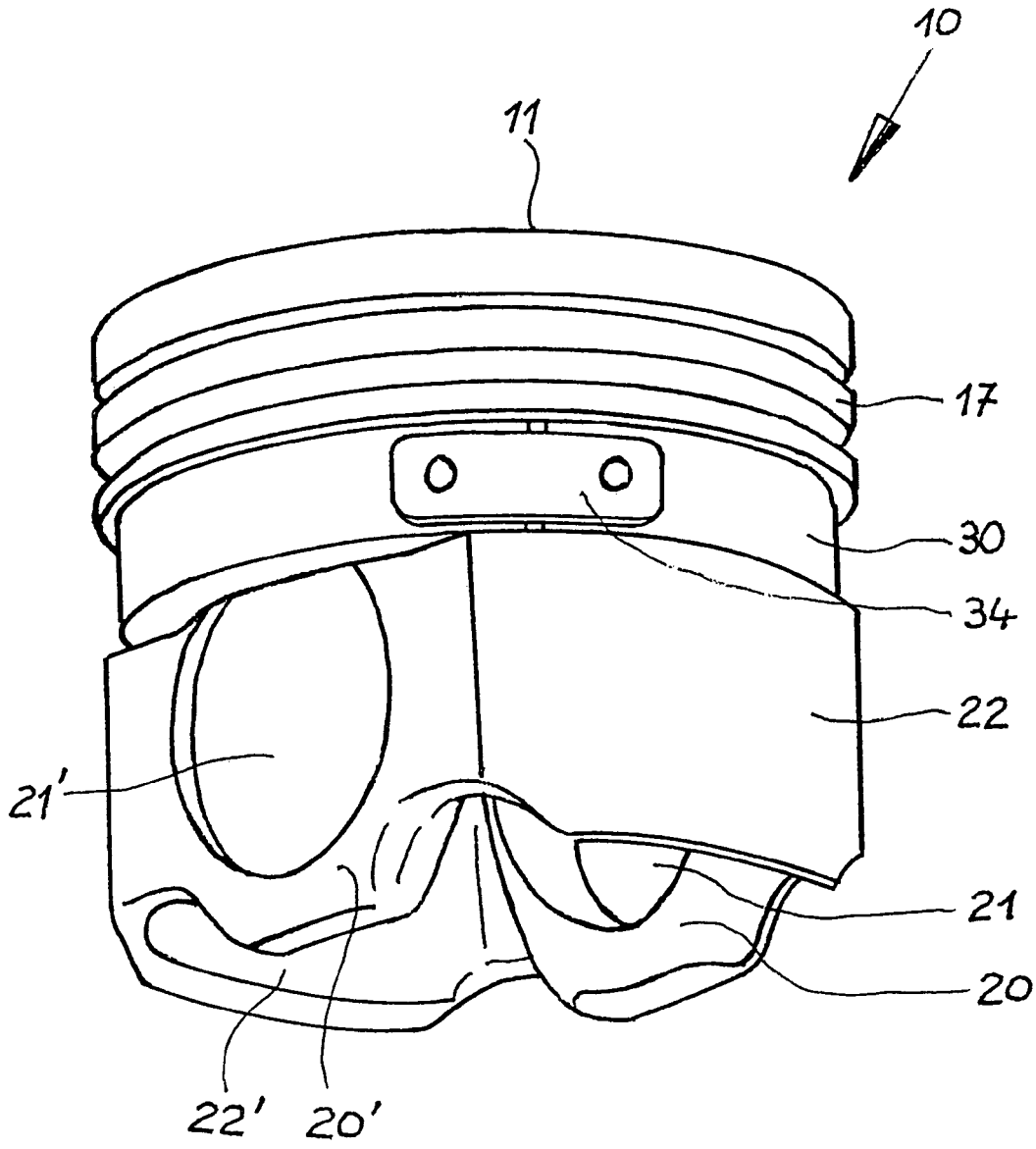
FIG. 4 shows a perspective view of the piston according to FIG. 1.

Referring now in detail to the drawings and, in particular, FIGS. 1, 2, and 4 show a one-part piston 10 for an internal combustion engine. Piston 10 is made of steel, and has a piston head 11 and a piston skirt 12, which are connected in one piece with one another by way of a skirt connection 13. Piston head 11 has a piston crown 14 and a combustion chamber bowl 15. In the radially outer region of piston head 11, a ring-shaped circumferential cooling channel 16 is disposed, the radially outer delimitation of which is formed by a ring wall 17 formed on piston crown 14, and the radially inner delimitation of which is formed by a ring rib 18. Ring wall 17 serves as a piston ring insert in this connection, and ends with a horizontal face surface 19 that faces piston skirt 12.

Two pin bosses 20, 20' having two aligning pin bores 21, 21' are formed on piston head 11. The face surfaces of pin bosses 20, 20' are set back in the direction of the longitudinal piston axis, relative to ring wall 17. Pin bosses 20, 20' are connected with one another by way of skirt elements 22, 22'. Skirt elements 22, 22' are formed on piston head 11 by way of shaft connection 13.

Shaft connection 13 is set back in the direction of the longitudinal piston axis, and makes a transition into ring rib 18. In this way, a ring-shaped recess 25 is formed, which is delimited, on the one hand, by shaft connection 13 and, on the other hand, by horizontal shoulders 24, 24' that face piston head 11. Shoulders 24, 24' form the upper delimitation of skirt elements 22, 22'.

A cover ring 30 having an outer shank 31, an inner shank 32, and a bottom crosspiece 33 that connects the two shanks is fitted in between ring wall 17 and skirt elements 22, 22'. In this connection, the upper edge of outer shank 31 rests against the face surface 19 of ring wall 17, and bottom crosspiece 33 rests against shoulders 24, 24' of skirt elements 22, 22'. Inner shank 32 rests against skirt connection 13. In this manner, ring-shaped recess 25 is closed off and sealed towards the outside. The ring-shaped circumferential cooling channel 16 and ring-shaped recess 25 now form a new, significantly larger cooling channel. In the region of pin bosses 20, 20', which are set back relative to ring wall 17 and therefore do not have any support surfaces comparable to shoulders 24, 24', inner shank 32 of cover ring 30 projects into the clear opening of pin bores 21, 21' (see FIG. 4). Inner shank 32 of cover ring 30 forms a retaining element, in this region, to prevent axial movement of piston pin 23, which is shown with a dot-dash line in FIG. 2, and is accommodated in pin bores 21, 21'. The retaining elements in the form of snap rings or Seeger rings that were previously required are therefore no longer necessary. Therefore pin bosses 20, 20' no longer have any pin retaining grooves, as is also clearly evident in FIGS. 1 and 2.

Figure 3:
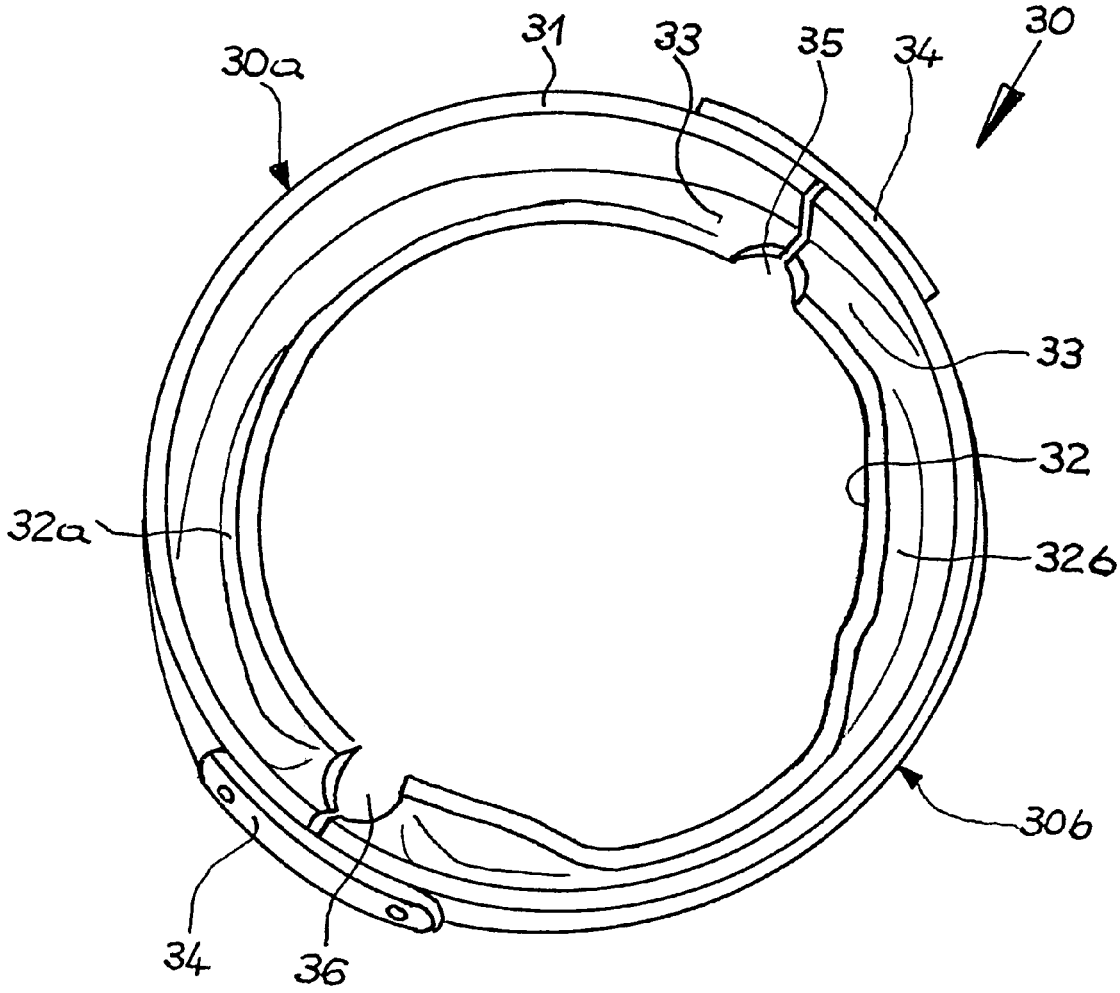
FIG. 3 shows a perspective top view of an embodiment of a cover ring according to the invention.

An exemplary embodiment of a cover ring 30 according to the invention is shown in FIG. 3. Cover ring 30 can be produced from a metallic material, such as steel or aluminum or a suitable alloy, and can be cast or forged. However, cover ring 30 can also be produced from a heat-resistant plastic, for example using the injection-molding process. Cover ring 30 has an outer shank 31, an inner shank 32, and a bottom crosspiece 33 that connects the two shanks. In the exemplary embodiment, cover ring 30 is approximately U-shaped in cross-section. However, it can also have other suitable cross-sections. In the exemplary embodiment, cover ring 30 is configured in two parts. The two ring segments 30*a* and 30*b* are riveted together by means of tabs 34 in the exemplary embodiment. However, ring segments 30*a* and 30*b* can also be connected with one another in any other desired manner, for example by means of snapping, locking, clipping, gluing, welding, soldering, etc.

Cover ring 30 furthermore has an inlet opening 35 and an outlet opening 36 that lies diametrically opposite inlet opening 35, for a coolant. Inlet opening 35 and outlet opening 36 are configured in the join regions of ring segments 30*a* and 30*b*, in the exemplary embodiment. Accordingly, regions 32*a* and 32*b* of inner shank 32 that lie outside the join regions form the retaining elements for piston pin 23. The inner shank 32 preferably has a height that varies over its ring-shaped progression, and regions 32*a*, 32*b* that serve as retaining elements are configured to be the highest. In contrast to this, the height of outer shank 31 is constant, because it rests against face surface 19 of ring wall 17 in the installed state of cover ring 30.

The bottom crosspiece 33 of cover ring 30 is configured in such a manner, in the exemplary embodiment, that it has an incline, proceeding from inlet opening 35 to outlet opening 36. In this way, the flow velocity of the coolant towards the outlet opening 35 is increased, in particular, so that a harmful backup of coolant is avoided. The varying height of inner shank 32 also influences the flow characteristics of the coolant, so that these can be adjusted in targeted manner.

Accordingly, while only a few embodiments of the present invention have been shown and described, it is obvious that many changes and modifications may be made thereunto without departing from the spirit and scope of the invention.

What is claimed is:

1. A one-part piston for an internal combustion engine, comprising:

a piston head having a ring-shaped circumferential cooling channel for a coolant;

a piston skirt spaced apart from the piston head by a ring-shaped recess;

at least one pin bore for accommodating a piston pin; and a cover ring that closes off the circumferential cooling channel, said ring comprising at least two segments, wherein one region of the cover ring projects at least partially into a clear opening of the at least one pin bore in such a manner that the cover ring simultaneously forms a retaining element for the piston pin.

2. A piston according to claim 1, wherein the cover ring has an inner shank and an outer shank, which are connected with one another by a bottom crosspiece.

3. A piston according to claim 2, wherein the cover ring is configured to be approximately U-shaped or approximately V-shaped in cross-section.

4. A piston according to claim 2, wherein the inner shank projects into the clear opening of the at least one pin bore and forms the retaining element for the piston pin.

5. A piston according to claim 2, wherein the outer shank forms a delimitation of the ring-shaped recess on the piston skirt side.

6. A piston according to claim 2, wherein the ring-shaped recess is disposed between a face surface configured on a ring wall of the piston, and at least one shoulder formed on the piston skirt, and wherein the cover ring rests against the face surface with its outer shank, and against the at least one shoulder with its bottom crosspiece.

7. A piston according to claim 2, wherein the inner shank of the cover ring rests against a skirt connection of the piston.

8. A piston according to claim 2, wherein a height of the inner shank varies over a circumference of the cover ring.

9. A piston according to claim 2, wherein the angle position of the inner shank relative to the center axis of the cover ring varies over a circumference of the cover ring.

10. A piston according to claim 1, wherein the cover ring has an inlet opening and an outlet opening that lies diametrically opposite the inlet opening, and wherein the cover ring forms a flow channel for the coolant that is inclined from the inlet opening to the outlet opening.

11. A cover ring for a ring-shaped circumferential cooling channel of a one-part piston for an internal combustion engine, the piston having a piston head and a piston skirt spaced apart from the piston head by means of a ring-shaped recess, which piston has at least one pin bore for accommodating a piston pin, the cover ring comprising two or more segments and having one region that simultaneously forms a retaining element for the piston pin.

12. A cover ring according to claim 11, wherein the cover ring has an inner shank and an outer shank, said shanks being connected with one another by means of a bottom crosspiece.

13. A cover ring according to claim 12, wherein the cover ring is approximately U-shaped or approximately V-shaped in cross-section.

14. A cover ring according to claim 12, wherein the inner shank forms the retaining element for the piston pin, said inner shank projecting into a clear opening of the at least one pin bore when the cover ring is installed on the piston.

15. A cover ring according to claim 12, wherein the outer shank forms a delimitation of the ring-shaped recess on a piston skirt side of the piston when the cover ring is installed on the piston.

16. A cover ring according to claim 12, wherein a height of the inner shank varies over a circumference of the cover ring.

17. A cover ring according to claim 12, wherein an angle position of the inner shank relative to a center axis of the cover ring varies over a circumference of the cover ring.

18. A cover ring according to claim 11, wherein the cover ring has an inlet opening and an outlet opening that lies diametrically opposite the inlet opening, and wherein the cover ring forms a flow channel for the coolant that is inclined from the inlet opening to the outlet opening.

19. A piston according to claim 2, wherein the cover ring is configured to be U-shaped or V-shaped in cross-section.

20. A cover ring according to claim 12, wherein the cover ring is U-shaped or V-shaped in cross-section.

* * * * *